United States Patent [19]

Marcel et al.

[11] Patent Number: 4,591,009

[45] Date of Patent: May 27, 1986

[54] DRILL SOUNDPROOFING DEVICE

[75] Inventors: Frédéric E. Marcel, Verneuil.En.Halatte; Francois J. M. Maume, Pont-Ste-Maxence, both of France

[73] Assignee: Charbonnages de France, Paris, France

[21] Appl. No.: 662,629

[22] Filed: Oct. 19, 1984

[30] Foreign Application Priority Data

Oct. 24, 1983 [FR] France ..... 83 16879

[51] Int. Cl.[4] ..... E21C 7/00; E21B 17/00

[52] U.S. Cl. ..... 175/320; 181/230

[58] Field of Search ..... 175/320, 293, 296; 173/DIG. 2; 181/230, 207, 196

[56] References Cited

U.S. PATENT DOCUMENTS

| | | | |
|---|---|---|---|
| 3,848,931 | 11/1974 | Swisher . | |
| 3,926,265 | 12/1975 | Bouyoucos | 175/320 X |
| 3,971,447 | 7/1976 | Ahlberg et al. | 175/320 X |
| 4,068,742 | 1/1978 | Resare . | |
| 4,108,258 | 8/1978 | Ekwall | 175/320 |
| 4,387,775 | 6/1983 | Adolfsson | 175/320 X |
| 4,393,947 | 7/1983 | Lutze et al. . | |

FOREIGN PATENT DOCUMENTS

| | | |
|---|---|---|
| 671115 | 10/1955 | Belgium . |
| 1401587 | 4/1965 | France . |

OTHER PUBLICATIONS

"Noise Control of Jumbo-Mounted Percussive Drills", Erich K. Bender et al., Noise Control Engineering, Nov.-Dec. 1980.

*Primary Examiner*—Stuart S. Levy
*Assistant Examiner*—Thomas R. Hannon
*Attorney, Agent, or Firm*—Cushman, Darby & Cushman

[57] ABSTRACT

A soundproofing device for a drill which has an elongate shaft extending between a bit and a forged collar for attaching it to a pneumatic hammer comprises a sheath formed by a semi-rigid tube of plastics material adapted to surround the shaft without touching it. This sheath extends between sealed first mounting ring near the bit and second mounting ring near the hammer. These mounting ring are free to move relative to the shaft in rotation and in translation. Tests show a reduction in the noise level 5 m from the drill from 102 dBA to 89 dBA.

5 Claims, 3 Drawing Figures

DRILL SOUNDPROOFING DEVICE

BACKGROUND OF THE INVENTION

1. Field of the Invention

The object of the invention is a device whose function is to significantly reduce the noise produced by a drill when drilling a hole, in a mine, for example.

2. Description of the Prior Art

As a general rule, a drill of this kind is coupled to the driving shaft of a pneumatic or hydraulic hammer which rotates it with a percussive action. The hammer is itself installed on a drilling jumbo carrying a plurality of hammers. The noise created is considerable, reaching and even exceeding 110 dB. It is a cause of irreversible occupational disability, in particular deafness, for persons working in the vicinity.

It is known that there are three main sources of the noise produced by a percussive rotary drill: exhaust compressed air, the drill and the body of the hammer.

The invention relates to a device for attenuating the noise due to the drill. The latter comprises an elongated shaft whose profile in transverse cross-section is more often than not polygonal, or sometimes cylindrical, with a first end part which features a forged collar for coupling it to the hammer and a second end part fitted with a bit of larger diameter than the shaft. The bit may be integral with the shaft or attached to the latter, by means of a screwthread, for example.

In both cases the bit comprises a cutting tip of frusto-conical profile of which the larger diameter, that of the end surface with cutting edges, determines the diameter of the drilled hole. To the rear of this end part the bit comprises a cylindrical body whose diameter is significantly larger than that of the shaft.

It has already be proposed to make use of this difference in the transverse dimensions of the shaft and the bit body to soundproof the drill. In the journal "NOISE CONTROL ENGINEERING", volume 15, number 3 of November-December 1980, there is described in an article titled "Noise control of jumbo-mounted percussive drills" a means of soundproofing drills. This consists in a composite sheath fitted over the shaft of the drill over its entire length between the bit and the hammer. This sheath comprises a coating of plastics material with a high molecular weight which covers the surface of the shaft, an elastic intermediate layer of open cell foam and an outside metal tube. At a frequency of 2,000 Hz this device attenuates the noise from a level of 108 dB without the sheath to a value of 101 dB with the sheath.

The principal objective of the invention is to provide a device for attenuating the noise produced by a drill which is at least as effective as the device mentioned hereinabove but the cost of which is significantly reduced and the service life of which is considerably increased.

SUMMARY OF THE INVENTION

The invention consists in a soundproofing device for a drill of the type which has an elongate shaft extending between a bit and a forged collar for attaching to a hammer, the device comprising a sheath of plastics material adapted to surround the shaft without touching same, sealed first mounting means adapted to be disposed near the bit and second mounting means adapted to be disposed near the hammer, the sheath extending between the first and second mounting means which are free to move relative to the shaft in rotation and in translation.

A cylindrical surface is preferably formed on the shaft at the intended location of the first mounting means.

The sheath is advantageously a semi-rigid plastics tube of the kind commercially available for use as water pipe. It is also possible, although not preferable, to use flexible plastics material tube, such as plastics water hose, for example. However, it is desirable that the sheath does not flap excessively around the bit, as might be the case with a flexible sheath. It is also preferable, for more effective soundproofing, for the sheath not to come into contact with the shaft of the drill between the mounting means.

Within the scope of the invention consideration may be given to lining the inside surface of the sheath with a layer of insulative material (foam, for example), but this layer must have an inside diameter which is larger than the largest transverse dimension of the shaft, so as not to come continuously into contact with the latter during drilling.

Other objects and advantages will appear from the following description of an example of the invention, when considered in connection with the accompanying drawing, and the novel features will be particularly pointed out in the appended claims.

DESCRIPTION OF THE PREFERRED EMBODIMENT

Figure 1:
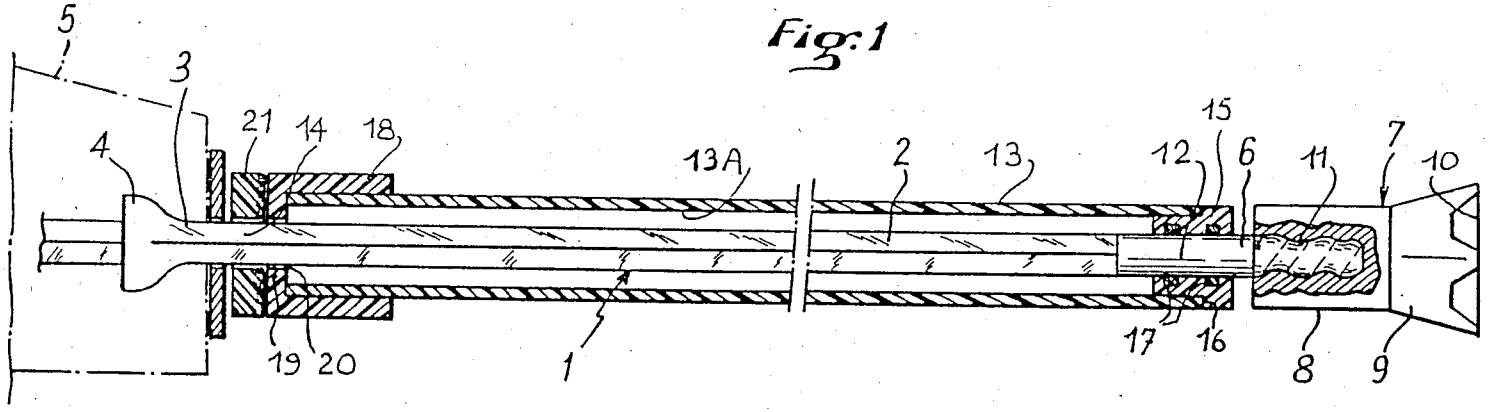
FIG. 1 is a view in elevation and in cross-section on a longitudinal plane through the axis of a drill equipped with a device in accordance with the invention.
Figure 3:
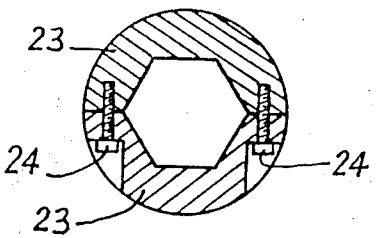
FIG. 3 is a view taken along line III—III of FIG. 2.
Figure 2:
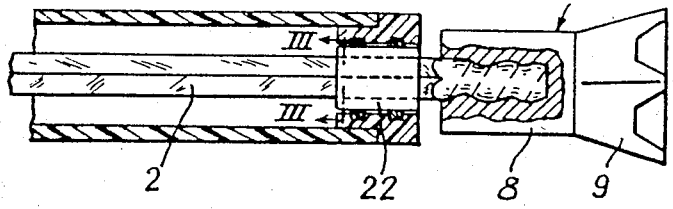
FIG. 2 is a cross-section view of a drill in which the elongate shaft is integral with the bit.

The drill 1 shown comprises an elongate shaft 2 which in this instance has a hexagonal profile in transverse cross-section, having a first end part 3 fitted with forged collar 4 for coupling it to a pneumatic hammer 5 shown in part in chain-dotted line. At its opposite end 6 the drill 1 is fitted with a bit 7.

The latter comprises a cylindrical body 8 whose diameter is significantly larger than the largest transverse dimension of the shaft 2 and a cutting end 9 of frusto-conical shape terminated by an end surface 10 with cutting edges.

In this instance, the bit 7 and the shaft 2 are coupled together by screwing the first onto the second; to this end the latter terminates in a threaded end portion 11 adjoining a machined cylindrical surface 12. The latter replaces over a short length the hexagonal profile of the shaft 2.

A sheath 13 of plastics material surrounds the shaft 2 between the cylindrical surface 12 and an area 14 near the pneumatic hammer 5.

In the area of the cylindrical surface 12 the mounting means for the sheath 13 comprise a ring 15 inserted into the sheath 13. This ring 15 preferably features a shoulder 16 beyond which its outside diameter is larger and advantageously equal to the outside diameter of the sheath 13. The latter has its annular end surface butted against the shoulder 16.

The ring 15 is preferably made from a plastics material which favours sliding, such as polytetrafluoroethylene (PTFE) or an analogous material, for example. It is a force fit into the sheath 13 and its inside cylindrical surface is fitted with at least one and preferably two sealing members 17 which provide a seal between the sheath and the cylindrical surface 12.

This arrangement is intended to oppose ingress into the sheath 13 of debris produced by the bit 7. Any equivalent sealed means for mounting the sheath 13 around the elongate shaft 2 could be used instead, provided that a gap is maintained between the two parts.

It will be noted that the machined cylindrical surface 12 is not indispensible. In the case of a drill of unitary construction in which the elongate shaft 2 is integral with the bit 7, a bush 22 divided into half-bushes 23 attached together by means of transverse screws 24 could be attached to the elongate shaft 2. This bush would have an inside surface with same polygonal profile as the elongate shaft 2 and a cylindrical outside surface adapted to receive the ring 15 with its sealing members 17. This second type of mounting is feasible when the sheath 13 has an inside diameter at least equal to the outside diameter of the forged collar 4 so that it can be threaded over the latter.

At its end near the pneumatic hammer 5, the mounting means for the sheath 13 comprises a centering and spacing ring 18. As this end is much less exposed to debris, it is not so important to achieve a perfect seal. The ring 18 contains internally the end part of the sheath 13 and it has a transverse end wall 19 in which is a hole 20 to provide free passage for the hexagonal shaft 2. The seal may be improved by means of a thick washer 21 which also surrounds the elongate shaft 2 and lies against the outside surface of the end wall 19. The ring 18 and the thick washer 21 are also of PTFE.

The ring 18 holds the sheath 13 away from the elongate shaft 2 and does not permit it to be entrained in rotation with it. This condition explains the necessity for a cylindrical surface with low friction of the sealed ring 15 near the bit 7. It is nevertheless possible within the context of the invention to line the inside surface 13*a* of the sheath 13, between the rings 15 and 18, with a layer of acoustically insulative material such as an appropriate foam (not shown) known per se provided that it does not come into contact with the elongate shaft 2 and that it does not entail the risk of entraining the sheath 13 in rotation.

The same consideration applies to the choice of the material of which the sheath 13 is constituted. A tube of a flexible plastics material may be employed provided that its flexibility is not such that it deflects tranversely to the point where it comes into contact with the elongate shaft 2. Also, the latter bends away from a rectilinear trajectory during drilling operations. It is desirable for the sheath 13 to curve in the same manner without ceasing to be held away from the elongate shaft 2, and without entailing the risk of flapping around the latter as could occur with an excessively flexible tube. A commercially available semi-rigid tube of plastics material, such as polyvinyl chloride, for example, is suitable.

Although of simple design and economic to manufacture, the device in accordance with the invention is certainly effective against sound radiated from the drill. The sheath 13 enters the hole drilled by the bit 7. Its outside diameter is preferably less than or at most equal to that of the body of the bit, so that it allows the drilling debris to be evacuated without imposing inadmissible loads on the drill by virtue of the freedom it has to rotate and move longitudinally relative to the elongate shaft 2.

Tests have been carried out using a type RK50 pneumatic hammer manufactured by the French company Maco-Meudon. The bit was one designed to drill a 48 mm hole. It was 108 mm long and 25 mm accross the flats. The sheath 13 was a semi-rigid PVC tube with inside and outside diameters of 34 mm and 40 mm, respectively, and an overall length of 3,040 mm.

Without the soundproofing device the noise radiated from the drill alone as measured at 1 m was 115.5 dBA (average of three readings). The noise level as measured at 5 m was 102 dBA (one measurement). Using the device in accordance with the invention, the noise levels as measured at the same points were respectively 103.8 and 89 dBA. The pneumatic hammer was fed with compressed air at a pressure of 6 bars and the drilling speed was approximately 87 cm/min.

It will be understood that various changes in the details, materials and arrangement of parts which have been herein described and illustrated in order to explain the nature of the invention may be made by those skilled in the art within the principle and scope of the invention as expressed in the appended claims.

We claim:

1. A sound proofing device for a drill of the type which has an elongate shaft extending between a bit and a forged collar for attachment to a hammer, the device comprising a sheath of semi-rigid plastics material surrounding said shaft without touching same, said material being bendable in the same manner as the drill when drilling is in progress, and acoustically insulated material lining the inside surface of said sheath and disposed so as to be spaced from said elongate shaft, sealed first mounting means disposed near said bit and second mounting means disposed near said hammer, said sheath with its lining extending between said first and second mounting means, said first and second mounting means being free to move relative to said shaft in rotation and translation, said first mounting means comprising a ring at least part of which is inserted inside said sheath and having a cylindrically shaped inside surface and at least one sealing member disposed between said cylindrical inside surface and a cylindrical surface of said shaft.

2. Device according to claim 1, wherein said cylindrical surface is formed on said shaft by machining same.

3. Device according to claim 1, further comprising a two-part bush adapted to be clamped to said shaft to define said cylindrical surface thereon, said bush having a cylindrical outside surface and an inside surface conforming to that of said shaft.

4. Device according to claim 1, wherein said second mounting means comprise a ring adapted to enclose an end part of said sheath and incorporating a transverse end wall formed with a hole for said shaft to pass through.

5. Device according to claim 4, further comprising, between said ring and said hammer, a thick washer through which said shaft freely passes adapted to bear against said transverse end wall of said ring.

* * * * *